United States Patent [19]

Neveux

[11] 4,106,558

[45] Aug. 15, 1978

[54] DEFLECTOR FOR HEAT EXCHANGER TUBE, ITS MANUFACTURING METHOD AND EXCHANGER COMPRISING SUCH DEFLECTORS

[75] Inventor: René Elie Neveux, Les Clayes-sous-Bois, France

[73] Assignee: Societe Anonyme Francaise du Ferodo, Paris, France

[21] Appl. No.: 700,485

[22] Filed: Jun. 28, 1976

[30] Foreign Application Priority Data

Aug. 6, 1975 [FR] France ..... 75 24538

[51] Int. Cl.[2] ..... F28F 1/40; F28F 13/12; F28F 9/24

[52] U.S. Cl. ..... 165/109; 138/38; 165/174

[58] Field of Search ..... 165/174, 109, 109 T; 138/38, 109; 110/97 D; 122/367 PF, 501, 502

[56] References Cited

U.S. PATENT DOCUMENTS

| | | | |
|---|---|---|---|
| 499,567 | 6/1893 | Normand | 165/174 |
| 971,480 | 9/1910 | Wegner | 138/38 |
| 1,056,373 | 3/1913 | Gegelken | 138/38 |
| 1,174,533 | 3/1916 | Townsend | 165/174 |
| 1,459,024 | 6/1923 | Hartburg | 165/174 |
| 1,496,509 | 6/1924 | Abell et al. | 138/38 |
| 1,991,788 | 2/1935 | Cartter | 165/174 |
| 2,056,492 | 10/1936 | Stout | 165/174 |
| 2,915,294 | 12/1959 | Christensen | 165/174 |
| 3,269,420 | 8/1966 | Woodling | 138/38 |
| 3,769,959 | 11/1973 | Parker | 138/38 |

FOREIGN PATENT DOCUMENTS

| | | | |
|---|---|---|---|
| 546,442 | 4/1956 | Belgium | 138/38 |
| 712,388 | 3/1968 | Belgium | 165/174 |
| 584,854 | 2/1925 | France | 138/38 |
| 1,250,888 | 12/1960 | France | 165/174 |
| 40,769 | 8/1965 | German Democratic Rep. | 165/110 |
| 373,129 | 12/1963 | Switzerland | 138/38 |
| 472,014 | 9/1937 | United Kingdom | 110/97 D |

*Primary Examiner*—Charles J. Myhre
*Assistant Examiner*—Sheldon Richter
*Attorney, Agent, or Firm*—Kane, Dalsimer, Kane, Sullivan & Kurucz

[57] ABSTRACT

A deflector for heat exchanger tube is provided which enhances exchange of heat between the various portions of the liquid flowing in the tube. It comprises a tail piece offset laterally relatively to the body of said deflector which prevents it from being swept away by the liquid, said tail piece being adapted to come into abutment with the edge of the tube.

5 Claims, 7 Drawing Figures

DEFLECTOR FOR HEAT EXCHANGER TUBE, ITS MANUFACTURING METHOD AND EXCHANGER COMPRISING SUCH DEFLECTORS

This invention has for its object a deflector for a heat exchanger tube, a manufacturing method for such a deflector and also a heat exchanger comprising tubes provided with such deflectors.

A heat exchanger tube is circulated with a liquid, sometimes called primary fluid, more often water in the case of an exchanger which is part of a motor vehicle equipment, the heat exchange being adapted to be made between said liquid and a secondary fluid, more often air, which sweeps vanes or blades spaced along the tube, advantage being taken of the thermal conductibility of the latter for the heat exchange between the primary fluid and the secondary fluid by means of the vanes.

Endeavours are made to have the liquid circulating in the tube communicating to the tube a maximum of its calories (in the case where the primary fluid is at a temperature higher than that of the secondary fluid) in the course of its travel from the inlet to the outlet of said tube.

It has been suggested, for this purpose, to place inside the tube a deflector, sometimes called turbulator, which prevents the liquid from flowing in the tube in parallel streams, this circulation mode leaving aside of the internal surface of the tube the central portions of the liquid vein.

Various deflector embodiments are known, some in the form of a thin band or strip with helicoidal configuration inside the tube; others with a thin band or strip placed diametrally to the tube and provided with transverse projections, preferably issued from cuttings or punctures in the band; yet others in the form of a wire wound in a spiral.

It has been observed that in a heat exchanger the tubes of which accomodated such turbulators, specially in an exchanger in which the header tanks have a relatively great height, it is not uncommon that the plate or wire, thin and consequently easily deformable, is swept by the liquid and obstructs ducts part of the heat exchanger or provided for its feeding.

To avoid this drawback, it has been suggested to place at the outlet of tubes comprising turbulators, a stopping means, for example a grating, usually made of plastics, with rectangular meshes the grate bars intersections of which are placed opposite the tube outlets. This grating, or ladder, constitutes an extra element of the heat exchanger, introduces losses momentum of the fluid and complicates the production of the exchanger.

It has been also suggested, to avoid the drawback hereabove mentioned to form into the end of the band or thin strip a fold which rests on the edge of the tube or on the manifold in which the tube is mounted, said fold being sometimes pierced with a hole for a screw or the like for securing it. However the requirement to form a fold at the end of the thin band or strip makes the manufacturing of such a deflector difficult.

It is an object of this invention to provide a deflector which avoids the above mentioned disadvantage without resorting to gratings or other accessories and also without any complications of its manufacturing process.

According to the invention a deflector is provided comprising a band or strip the width of which corresponds to the diameter of the tube, and one end of which is laterally offset relatively to the body of the band or strip, in such a way as to oppose escaping from the tube by abutment the band or strip being of constant width and having its lateral edges at one end or at the vicinity of said end provided with a section oblique relatively to the mean line of the band or strip.

For the production of such a deflector a plate or thin sheet, preferably metal, is punctured to form rows of cuttings and tongs, eventually perforations, after what said plate or sheet is cut up into bands or strips of constant width provided at one of their ends with beaks or tails the lateral edges of which are oblique relatively to the mean line of each of these bands or strips.

The following description, given by way of example, is made with reference to the accompanying drawing, wherein.

Figure 1:
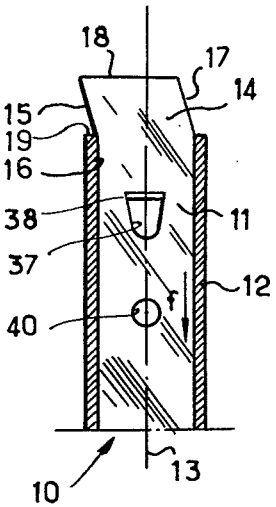
FIG. 1 is a schematical sectional view of a tube provided with a deflector according to this invention.

Reference is first made to FIG. 1. The body 11 of a deflector 10 introduced into a tube 12 of a heat exchanger has its mean line 13 which coincides substantially with the axis of the tube when the deflector is fitted therein. At one of its ends deflector 10 has a tail piece 14 one edge 15 of which at least is at a greater distance from the mean line 13 than the edge 16 of the body which it extends. The tail piece 14 is provided with an edge 17 parallel to the edge 15, the edges 15 and 17 being connected by a front edge 18 the length of which is substantially equal to the width of the body 11 measured transversally to the mean line 13. The body 11 can be planar and fitted with transverse elements such as tongs, or else be arranged in a spiral.

When the liquid circulates in the direction of the arrow *f*, the sweeping effect it may have on the deflector leads the edge 15 to cooperate with the end 19 of the tube 12, which opposes the progression of the deflector inside the tube.

Figure 2:
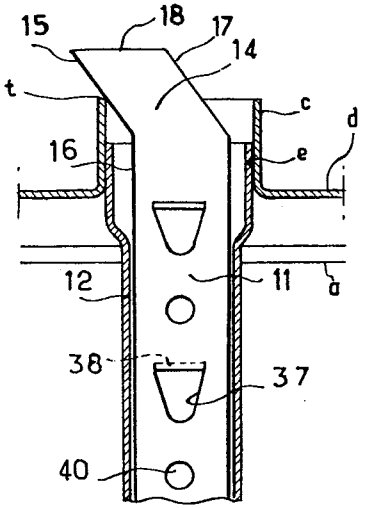
FIG. 2 is a sectional view of part of a heat exchanger, the tube of which is provided with a deflector according to this invention but for another embodiment.

In the embodiment shown on FIG. 2, the edge 15 engages in abutment with the end *t* of a flanged piece *c* with which is provided the manifold *d* into which is mounted the wider end *e* of tube 12. The tube 12 is fitted with vanes *a* and is in contact therewith.

Figure 3:
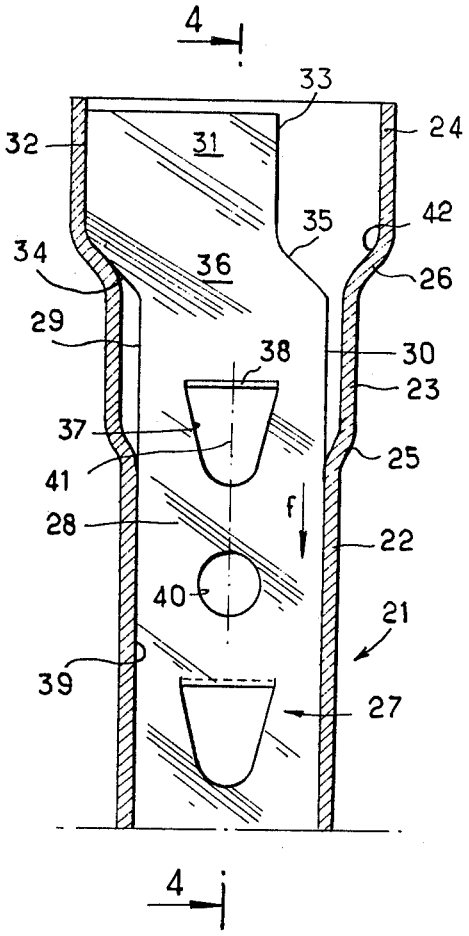
FIG. 3 is a sectional longitudinal view of a tube with two wider sections provided with a deflector according to this invention for yet another embodiment.
Figure 4:
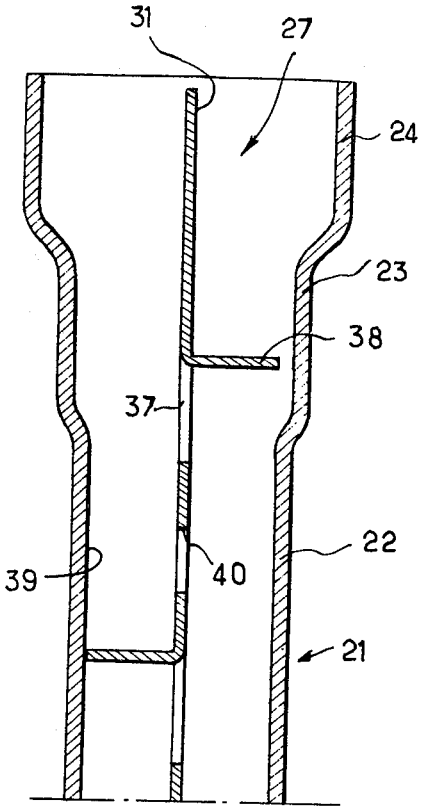
FIG. 4 is a sectional view along line 4—4 of FIG. 3.
Figure 5:
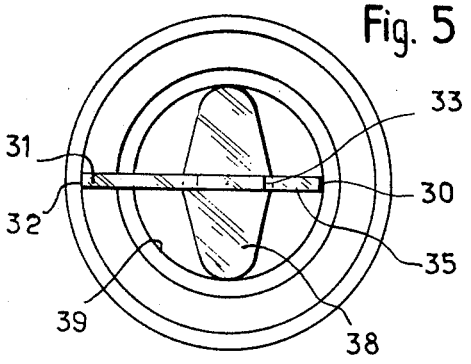
FIG. 5 is a corresponding view from above.

In the embodiment shown on FIGS. 3 to 5, the tube 21 for the liquid flow of a heat exchanger comprises a cylindrical body 22 extending into a first cylindrical section 23 of a diameter larger than that of the body 22 and into a second cylindrical section 24 of yet larger diameter than the cylindrical section 23, the junctions 25 and 26 between sections 22 and 23 on one hand, and on the other, the sections 23 and 24, being substantially frustro-conical.

The deflector or turbulator 27 comprises a thin planar metal plate for example brass or aluminium, the body 28 of which is defined by two parallel edges 29 and 30 with a distance between them substantially equal to the diameter of the body 22, but slightly less to enable introduction into the tube. The body 28 comprises, near one of its ends, a tail 31 defined by two edges 32 and 33, parallel to the edges 29 and 30 and which connect to these through oblique sections 34 and 35 defining a connecting section 36 between the body 28 and the tail 31.

The body 28 is provided with cuttings or punctures 37 from which are issued tongs 38 which, when the deflector is in position in the tube, constitute obstacles for the flow of water and force the central streams of said flow to be directed towards the internal surface 39 of the body 22 of the tube. The cuttings 37 are spaced along the central line 41 of the body 28 and directed alternatively on one side and on the other of said body which is also provided with circular perforations 40 to allow passage for water from one side of the tube to the side diametrally opposite.

When water flows in the tube in the direction shown by the arrow *f* it tends to sweep the deflector in the same direction but the oblique part 34 comes in abutment with the internal surface 42 of the connecting part 26 preventing any progression beyond the position shown on FIG. 3.

Figure 6:
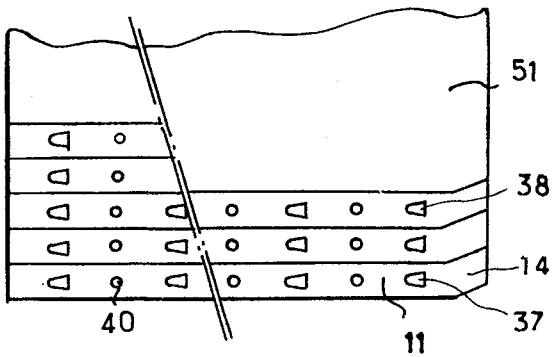
FIG. 6 is a schematical view of a plate or sheet in course of cutting.
Figure 7:
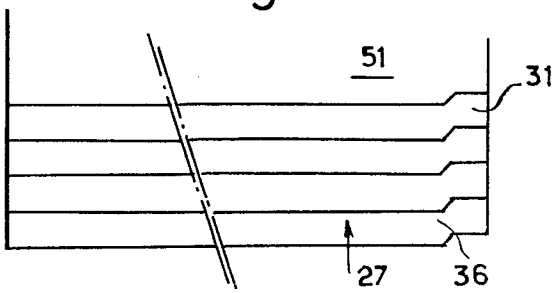
FIG. 7 is a view similar to FIG. 6, but for a modification.

For the production of the deflectors shown on FIGS. 1 to 5, one can proceed as follows:

Starting with a plate or thin sheet 51, for example metal, (FIGS. 6 and 7) the same is punctured to form rows of cuttings 37 and tongs 38 and eventually perforations 40. After that, the thin plate is cut up in bands or strips 11 or 28 provided with beaks or tails 14 or 31 offset relatively to the bodies 11 or 28.

What I claim is:

1. A deflector for a liquid tube of a heat exchanger to enhance the contact of the various portions of the liquid with the internal surface of the tube, said deflector comprising a band (strip) of constant width substantially equal to the inner diameter of the tube, and one end of which has the same width and is coplanar to at least the part of the body of the band (strip) which is in the vicinity of said end, the lateral edges of said end being oblique relatively to the lateral edges of said body, in such a manner as to oppose escaping from the tube by abutment when the deflector is swept by the circulating liquid.

2. A deflector according to claim 1, wherein said end is prolongated by a coplanar tail parallel to the body of the strip, but offset relatively to the mean line of the body of the band.

3. A deflector according to claim 1, wherein abutment is provided against a tubular part of a manifold in which is mounted the tube.

4. A deflector according to claim 3, wherein abutment of said oblique end is provided against a corresponding flared section of said tubular part.

5. A heat exchanger having manifolds, water headers, liquid circulation tubes extending between said manifolds, and deflectors within said tubes, said deflectors each comprising a band (strip) of constant width substantially equal to the inner diameter of the tube and one end of which has the same width and is coplanar to at least the part of the body of the band (strip) which is in the vicinity of said end, the lateral edges of said end being oblique relatively to the lateral edges of said body, in such a manner as to oppose escaping from the tube by abutment when the deflector is swept by the circulating liquid.

* * * * *